US005640906A

United States Patent [19]

Schmitt

[11] Patent Number: 5,640,906

[45] Date of Patent: Jun. 24, 1997

[54] SHORT MULTI-COLOR WEB-FED ROTARY PRINTING PRESS

[75] Inventor: Günter Karl Schmitt, Beindersheim, Germany

[73] Assignee: Albert-Frankenthal Aktiengesellschaft, Frankenthal, Germany

[21] Appl. No.: 518,305

[22] Filed: Aug. 23, 1995

[30] Foreign Application Priority Data

Aug. 24, 1994 [DE] Germany ..... 44 29 891.9

[51] Int. Cl.[6] ..... B41F 7/04; B41F 13/20

[52] U.S. Cl. ..... 101/177; 101/180

[58] Field of Search ..... 101/177, 178, 101/179, 180, 181, 182, 183, 184, 185, 220, 221, 222, 223–225, 136, 137, 138, 139, 140, 143, 144, 145, 247

[56] References Cited

U.S. PATENT DOCUMENTS 4,384,522 5/1983 Ehlers et al. ..... 101/177

4,831,926 5/1989 Bowman et al. .

FOREIGN PATENT DOCUMENTS 0 400 444 12/1990 European Pat. Off. .
35 00 319 7/1987 Germany .
WO87/05237 9/1987 WIPO .

OTHER PUBLICATIONS

Man Roland Brochure; Pamphlet No. 238 850; Polyman; 1990.

*Primary Examiner*—J. Reed Fisher
*Attorney, Agent, or Firm*—Jones, Tullar & Cooper, P.C.

[57] ABSTRACT

A short, multi-color, web-fed rotary printing press for job printing utilizes a vertical stack of bridge printing units which are supported by horizontally shiftable frame sections. The rubber blanket cylinder of each printing unit is at least twice as large as its associated printing cylinder but is always a whole number multiple in size. The printing cylinder in each printing unit rests on the upper half of its associated rubber blanket cylinder.

14 Claims, 4 Drawing Sheets

FIG.4
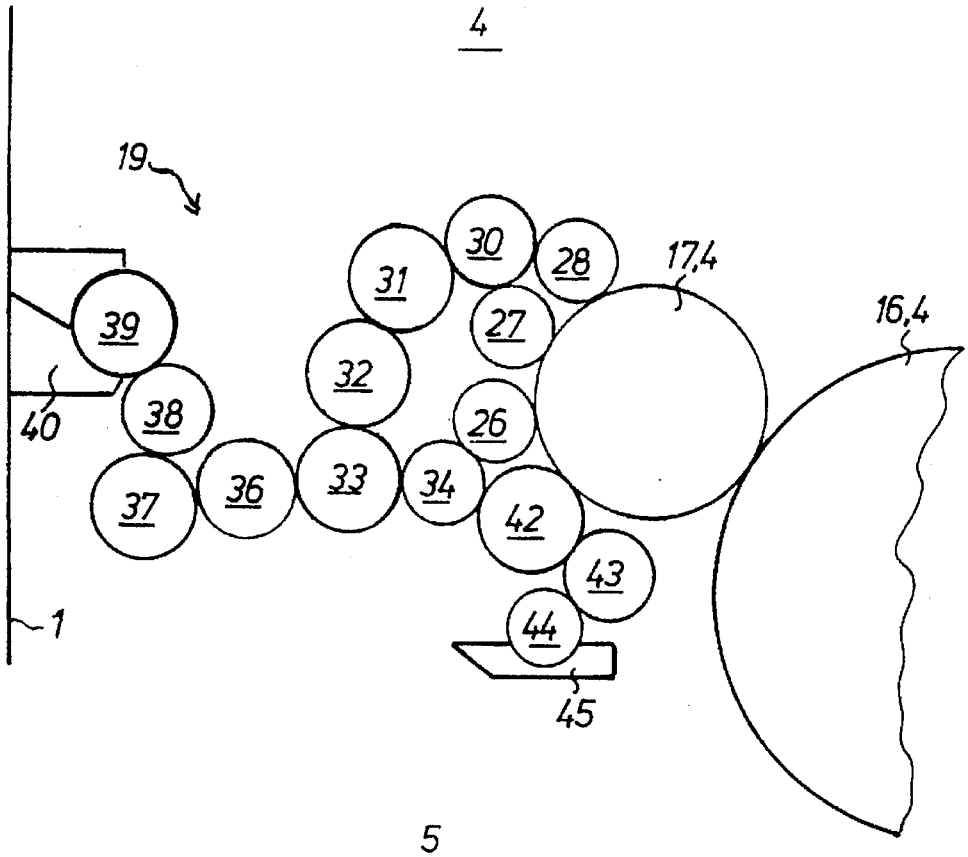
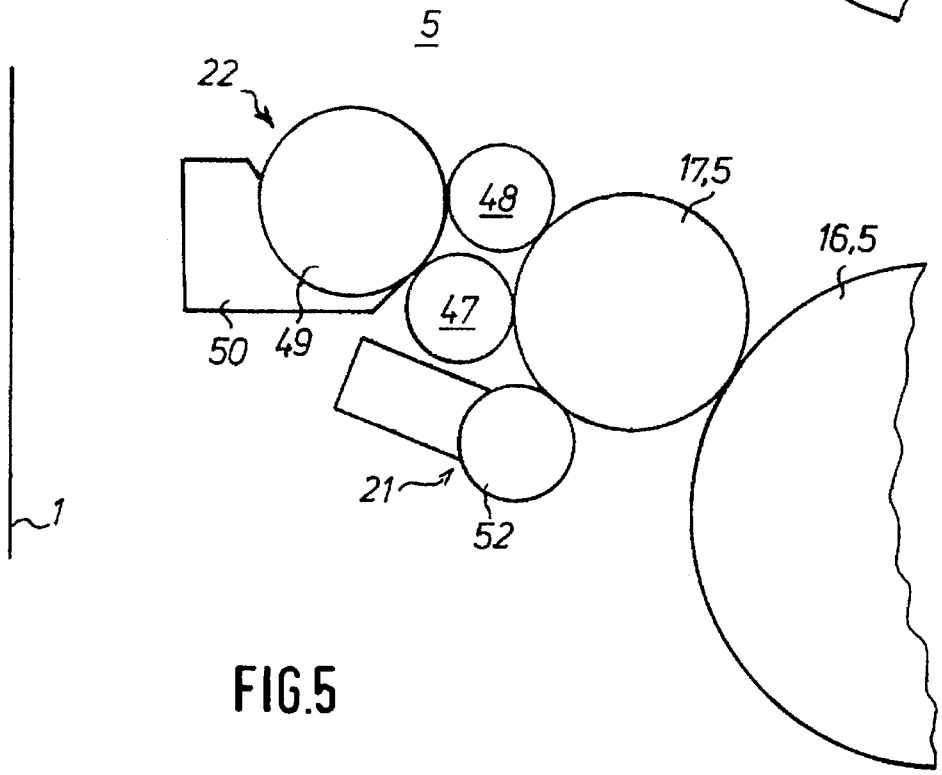
FIG.5

SHORT MULTI-COLOR WEB-FED ROTARY PRINTING PRESS

FIELD OF THE INVENTION

The present invention is directed generally to a short, multi-color web-fed rotary printing press. More particularly, the present invention is directed to a short, multi-color web-fed rotary printing press for job printing. Most specifically, the present invention is directed to a short, multi-color, web-fed rotary printing press having several sheet work bridge printing units which form a multiple printing system. In each of these bridge printing units the blanket cylinders from two cooperating printing units are in contact and print a paper web. The paper web is fed through several bridge printing couples which are placed vertically atop each other. After the paper web, which is fed to the multiple printing system from a roll changer, has been printed, it is guided, in the web travel direction, to a dryer and then to a folding device. The various components are arranged to provide a short, compact printing press.

DESCRIPTION OF THE PRIOR ART

A multi-color web-fed rotary printing press which has eight inking units and which is usable for job printing is described in a pamphlet from the company MAN-Roland Druckmaschinen AG (DE), their pamphlet No. 238 850 d/4.90.5 pd; Polyman from DRUPA 1990. This printing press includes a roll changer; four printing units disposed one after the other in the direction of web travel and usable to print in eight colors; a dryer; a cooling unit; a turning bar unit; and a folding device. This prior art multi-color, web-fed rotary printing press is depicted in FIG. 6 of the drawings accompanying the present application. As may be seen in that drawing, all of the various elements in this prior art device are aligned, in the direction of paper web travel, in a horizontal orientation. Each of the four printing units has one printing unit, including its inking unit, disposed above the horizontally extending web and one printing unit with its inking unit located below the paper web.

This prior art multi-color web-fed rotary printing press requires a significant length of space for its location. This great length results in large expenses for construction of the press as well as increased costs for the space required to house it. In addition, the paper web being printed must travel along a relatively long distance and such an elongated travel path between the several printing stations is quite apt to result in registration difficulties. A further limitation of this prior art device is that the inking units associated with the printing units have varying ink flow directions since the ink flow in the upper four of the printing units is downwardly directed while the ink flow in the lower four of the printing units is upwardly directed. This variation in ink flow direction causes the ink to behave in different ways, depending on the ink flow direction. The ink flowing from the top to the bottom of a unit will act differently from the same ink flowing from the bottom of a unit to the top of the unit. These different ink flow characteristics may result in print quality variations.

It will be seen that a need exists for a multi-color web-fed printing press which overcomes these limitations of the prior art devices. The short multi-color, web-fed rotary printing press in accordance with the present invention provides such a device and is a significant improvement in the art.

SUMMARY OF THE INVENTION

It is an object of the present invention to provide a short, multi-color, web-fed rotary printing press.

Another object of the present invention is to provide a short, multi-color, web-fed rotary printing press usable in job printing.

A further object of the present invention is to provide a short, multi-color, web-fed rotary printing press having several sheet work bridge printing units forming a multiple print system.

Yet another object of the present invention is to provide a short, multi-color, web-fed rotary printing press having the same structural height as prior art units and with a significantly shortened length.

Still a further object of the present invention is to provide a short, multi-color, web-fed rotary printing press having a plurality of 1/1 printing units and with a great paper web width and a printing cylinder of small diameter.

As will be discussed in greater detail in the description of the preferred embodiment, which is presented subsequently, the short, multi-color, web-fed rotary printing press in accordance with the present invention utilizes several sheet work printing units in which the blankets of each two cooperating units are in contact and print a paper web that passes therebetween. These printing units are thus arranged as bridge printing units and four such bridge printing units are arranged one above the other in the direction of paper web travel to form a multiple print system. After the paper web exits the last of these four bridge printing units, it is guided to a dryer and then to a folding unit. These bridge printing units can be divided into a left frame section and a right frame section or into left, middle and right frame sections. These frame sections may be shiftable generally horizontally toward and away from each other. The left frame section may receive the left printing units and the right frame section may receive the right printing units. Alternatively, the left and right sections may receive the left and right printing cylinders with the center section receiving the two blanket cylinders for each bridge printing unit. In each of these printing units, the blanket cylinder is at least twice as large in circumference as its associated printing cylinder with this size ratio always being a whole number. Further, in each printing unit, the printing cylinder engages the upper half of its associated rubber blanket cylinder.

The short, multi-color, web-fed rotary printing press in accordance with the present invention has several advantages over the prior art devices. The subject printing press has substantially the same structural height as the prior art devices but has a considerably reduced total length. This shortened overall length results in substantial savings in building costs. Because of the shortened length of the subject printing press that is due in part to the positioning of the bridge printing units one above the other, it has become possible to drastically shorten a multi-color, web-fed rotary printing press for use in job printing.

In the present invention, the several bridge printing units are all arranged with their inking units positioned in the same location in each of the left and right side printing units. The ink flow in each of the eight printing units is in the same direction. This insures that the same ink behavior characteristics will be present in all of the printing units.

Since the several printing units that make up the four bridge printing units are situated at a reduced distance from each other, as compared to the prior art devices, the proportion of paper web waste during press starting and stopping operations is reduced. Particularly in job printing, where printing plate changes are quite common, this reduced paper web waste is an important consideration.

In the printing press of the present invention, it is possible to utilize a printing cylinder in each printing unit, which has a diameter of, for example, only 175 mm in spite of a large paper web width of, for example, 1850 mm. The small diameter printing cylinder does not result in any deterioration in print quality and there are no printing cylinder bending problems occurring in the printing cylinder, even during operation at high speeds. It is therefore not necessary to use so-called circumferentially double-size printing cylinders which have two so-called section lengths around their circumference. The printing cylinders can be of single section length. This means that only one printing plate of one section length is located on the circumference of the printing cylinder in each printing unit of the subject invention.

The printing system in accordance with the present invention has a structural height that is less than printing units of satellite construction. Registration accuracy is increased. In addition it is no longer required to use so-called "left presses" or "right presses". The "fan out" effect in the printed paper web is prevented to a large degree because of the short distances of the printing stations or bridge printing units from each other.

The short, multi-color, web-fed rotary printing press in accordance with the present invention overcomes the limitations of the prior art. It is a substantial advance in the art.

BRIEF DESCRIPTION OF THE DRAWINGS

While the novel features of the short, multi-color, web-fed rotary printing press in accordance with the present invention are set forth with particularity in the appended claims, a full and complete understanding of the invention may be had by referring to the detailed description of the preferred embodiment which is presented subsequently, and as illustrated in the accompanying drawings, in which:

FIG. 4 is an enlarged schematic side elevation view of a printing unit of FIG. 2 of the present invention with an inking unit and a damping unit;

FIG. 5 is an enlarged schematic side elevation view of a printing unit of FIG. 3 of the present invention with an anilox inking unit;

DETAILED DESCRIPTION OF THE PREFERRED EMBODIMENT

Figure 1:
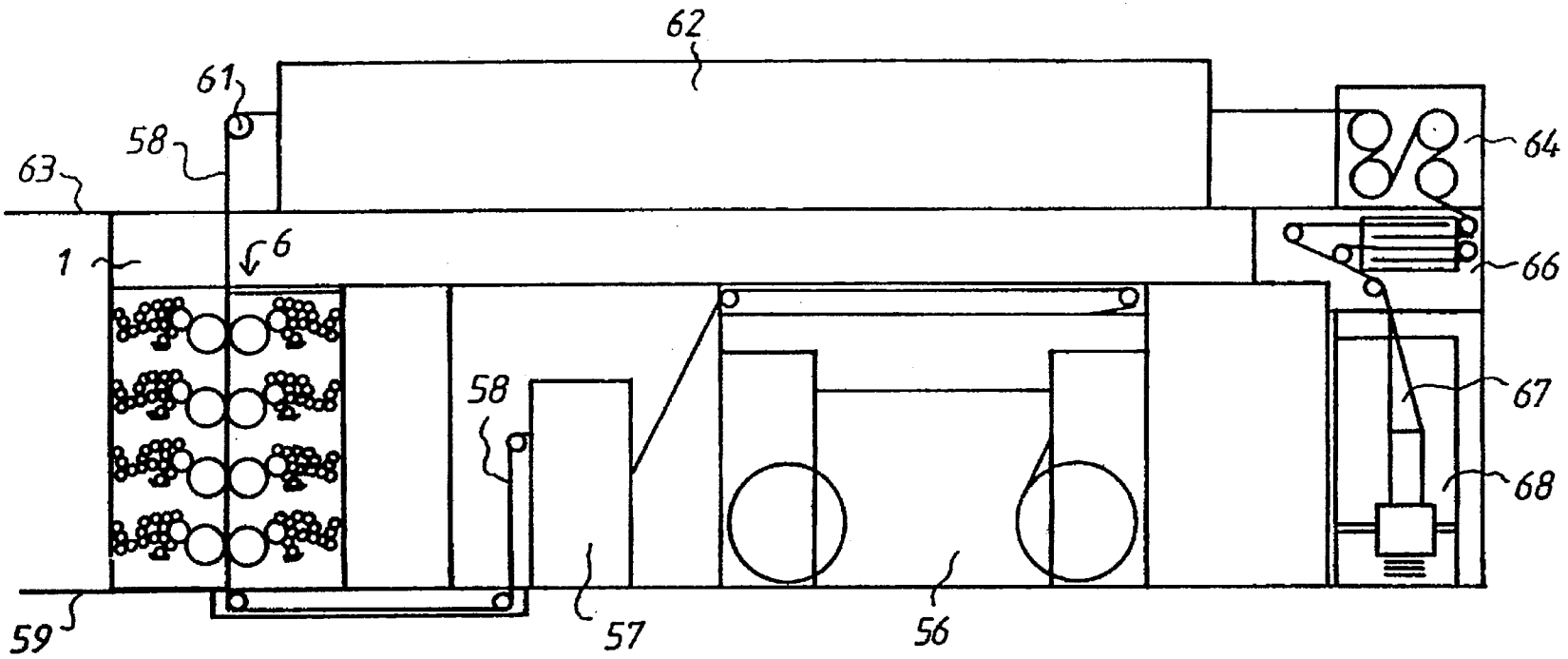
FIG. 1 is a schematic side elevation view of the short, multi-color, web-fed rotary printing unit in accordance with the present invention.
Figure 2:
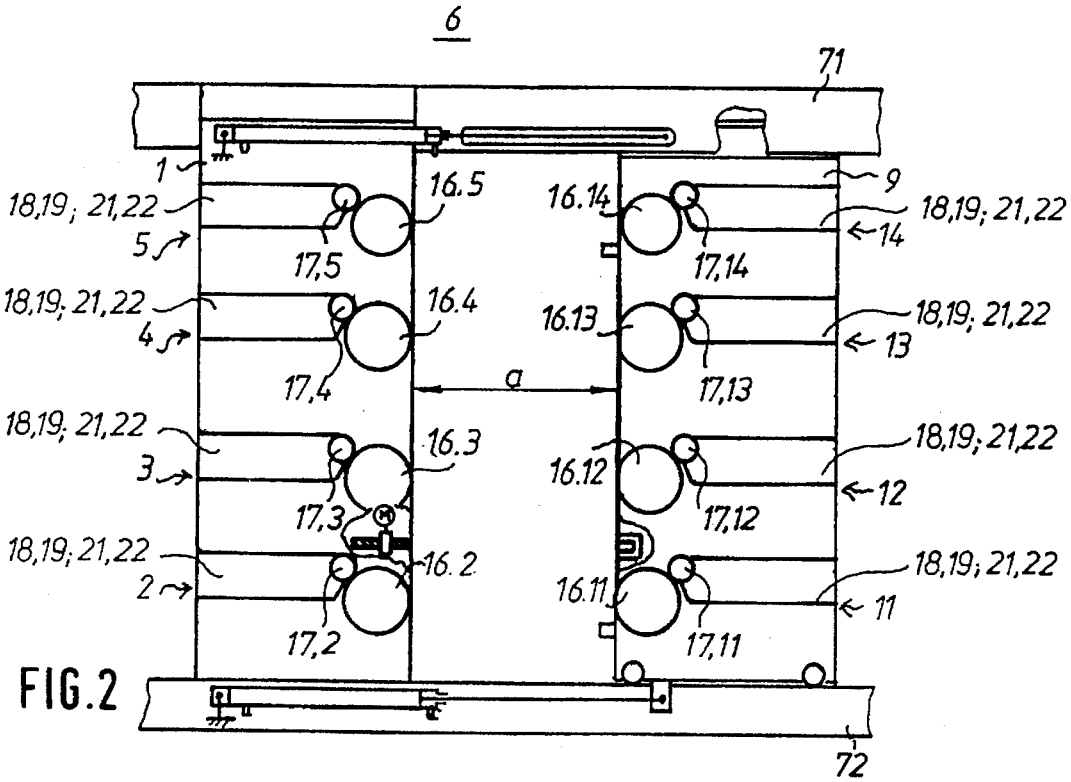
FIG. 2 is a side elevation view of the printing units of the subject invention and showing the displaceable frame section shifted to a rest position.
Figure 3:
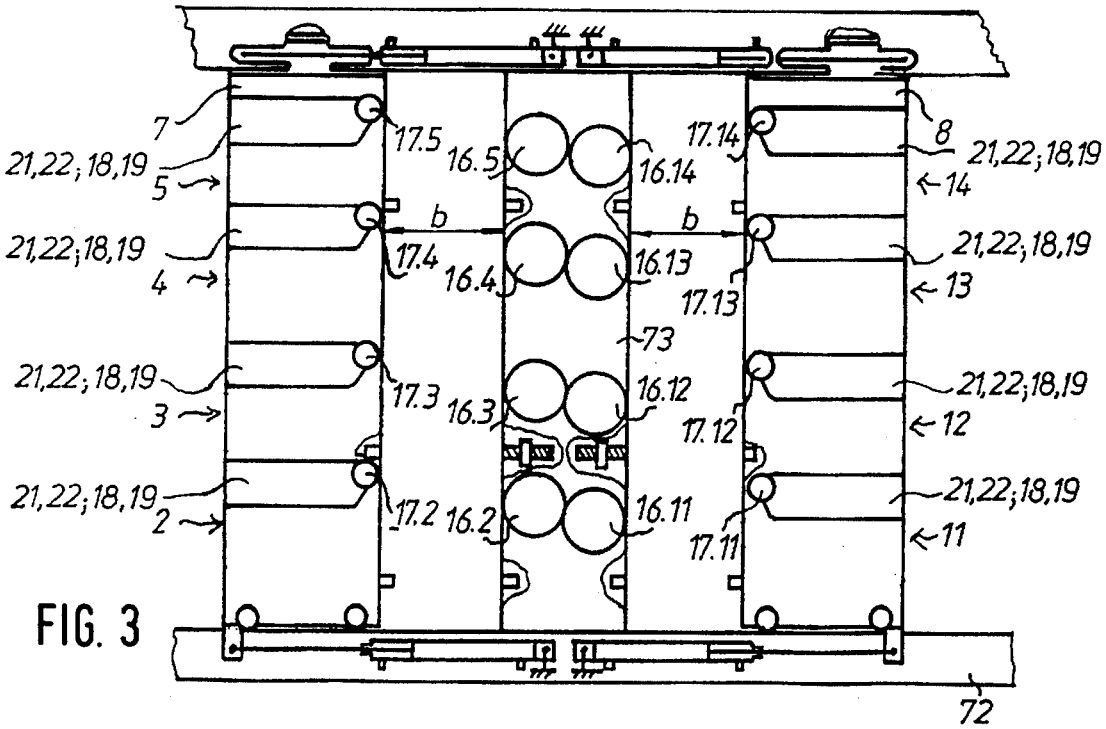
FIG. 3 is a side elevation view generally similar to FIG. 2 and showing two displaceable frame sections for receiving the printing units.
Figure 7:
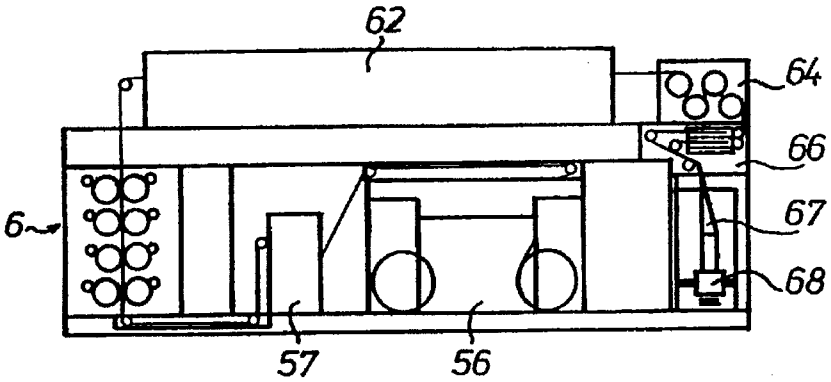
FIG. 7 is a schematic side elevation view of the short, multi-color, web-fed rotary printing press for job printing in accordance with the present invention and on the same scale as the prior art device depicted in FIG. 6.

Referring initially to FIGS. 1 and 7, there may be seen a schematic side elevation view of a short, multi-color, web-fed rotary printing press for job printing in accordance with the present invention. Multiple printing systems, generally at 6, which consist of left printing units 2 to 5, and right printing units 11 to 14, as may be seen more clearly in FIGS. 2 and 3 are shown as being situated in a first horizontal plane 59 between an upper horizontal support 71 and a lower horizontal support 72. These supports form the frame for the short, multi-color, web-fed rotary printing press for job printing in accordance with the present invention.

Each of the left printing units 2 to 5 and the right printing units 11 to 14 respectively have rubber blanket cylinders 16.2 to 16.5 and 16.11 to 16.14, as may also be seen in FIGS. 2 and 3. The left and right printing units are disposed as four generally vertically stacked bridge printing units 2–11; 3–12; 4–13; and 5–14, respectively. In each such bridge printing units the blanket cylinder of the left printing unit is in contact with the blanket cylinder of the right printing unit when the printing press is in its operative position, as depicted in FIGS. 1 and 7.

A printing cylinder 17.2 to 17.5 and 17.11 to 17.14 is associated with each blanket cylinder 16.2 to 16.5 and 16.11 to 16.14, respectively. Each of the printing cylinders is positioned so that it engages the periphery of its associated blanket cylinder in the upper half of the blanket cylinder's periphery. Each of the printing cylinders has, in its ready to print conditions; i.e. with a printing plate or plates secured to its periphery, a first circumferential size. Each of the blanket cylinders has in its ready to print condition; i.e. with its surface provided with packings, a second circumferential size. The blanket cylinder circumferential size is at least twice the printing cylinder circumferential size. It may be more that twice the size but is always a whole number multiple.

As may be seen in FIG. 1, a conventional dampening unit 17 and a conventional inking unit 19 can be associated with each printing cylinder 17. It is also possible to utilize spray dampening units 21 as well as anilox short inking units 22, with the printing cylinders 17.2 to 17.5 and 17.11 to 17.14, as is depicted schematically in FIG. 5.

Referring now to FIG. 2, each of the bridge printing units 2–11; 3–12; 4–13 and 5–14 can be vertically divided symmetrically and can be separated into left printing units 2 to 5 and right printing units 11 to 14. It order to facilitate the performance of maintenance work on the printing units, either the left or the right printing units can be supported on a displaceable frame. As depicted in FIG. 2, the left frame section 1, which supports the left printing units 2 to 5, can be fixed between the vertically spaced supports 71 and 72. The right printing units 11 to 14 may be supported on a shiftable right frame section 9 that can be disposed on rollers so that it is shiftable through a distance "a" with respect to the fixed, left frame section 1. This distance "a" will be sufficient to provide access to the left and right printing units 2 to 5 and 11 to 14, respectively so that necessary maintenance work can be performed. The two frame sections 1 and 9 can both be shiftable if desired. Suitable locking devices (not shown) are used to lock the frames in place.

In an alternative arrangement, as depicted in FIG. 3, all of the rubber blanket cylinders 16.2 to 16.5 and 16.11 to 16.14 for the left and right printing units 2 to 5 and 11 to 4, respectively, can be supported on a stationary center section 73 which is fixed in place between the two supports 71 and 72. In this arrangement, the rubber blanket cylinders 16.2 to 16.5 and 16.11 to 16.14 of the four vertically stacked bridge printing units stay in contact with each other, leaving only sufficient spacing for the passing of a paper web 58 which will be printed by the subject press assembly. The left printing cylinders 17.2 to 17.5 of the left printing units 2 to 5, together with their associated spray dampening units 21 and short anilox inking units 22 are disposed on a left shiftable frame section 7. In the same manner, the right printing cylinders 17.11 to 17.14 of the right printing units 11 to 14, together with their associated spray dampening units 21 and anilox short inking units 22 are disposed on a horizontally shiftable right frame section 8. The shiftable frame sections 7, 8 or 9 can each be supported by lower support 72 on suitable rollers, not depicted in detail, and can be moved by suitable double acting working cylinders that are not specifically shown in the drawings. The top of each of the left and right shiftable frame sections 7 and 8 or of the sole shiftable frame sections 9 can be guided in the upper horizontal support 71. In each of the two variations of the shiftable and fixed frame sections, the inking and dampening units 18 and 19 can be of conventional construction or can be an anilox short inking unit 22 or a spray dampening unit 21, as was previously discussed. In the position of rest depicted in FIG. 3, the left and right shiftable frame section 7 and 8 are each shifted with respect to the central fixed frame section 73 through a distance "b". It will be understood that this distance "b" is sufficient to allow a person access to the left and right printing unit components.

A conventional inking unit 19 that can be utilized to supply ink to any one of the printing cylinders 17.2 to 17.5 or 17.11 to 17.14 is shown in detail in FIG. 4. This conventional inking unit 19 consists of three ink application rollers 26, 27 and 28 resting against the printing cylinder 17.4 with the uppermost ink application roller 28 of these, in turn, being in contact through three ink transfer rollers 30, 31, 32 as well as through two ink distributing cylinders 33, 34 with the lower ink application roller 26 resting against the printing cylinder 17.4. The lower ink distribution roller 33 is connected by an ink transfer roller 36, together with an ink distribution cylinder 37 and a lifting roller 38 with the ink ductor 39 of an ink duct 40. A dampening application roller 42 of the dampening unit 18, which is resting against the printing cylinder 17.4, is connected through a dampening transfer roller 43 with a dampening ductor 44 of a dampening water duct 45.

In the printing unit depicted in FIG. 5, there is provided an anilox short inking unit 22 and a spray dampening unit 21 in contact with the printing cylinder 17.5 of the right printing unit 5. This anilox short inking unit 22 consists of one or two ink application rollers 47, 48 resting against the printing cylinder 17.5 and which are, in turn, connected by an ink roller 49 with an ink trough 50. It is also possible to employ a known chamber doctor blade as well as an ink catching trough in place of an ink trough 50. The dampening unit 21, embodied as a spray dampening unit, if desired, can consist of a dampening agent application roller 52, resting against the printing cylinder 17.5, and of a known spray device 53.

Referring again primarily to FIG. 1, in the short multi-color web-fed rotary printing unit of the present invention, a paper web 58 to be printed, is supplied from a roll changer 56 through a draw-in unit 57. The paper web 58 is fed to the bottom of the multiple printing system 6 which consists of the four bridge printing units 2–11, 3–12, 4–13 and 5–14, which are positioned vertically stacked above each other. The roll changer 56 and the draw-in unit 57 are generally conventional in construction and are located on the same horizontally extending first plane 59. After the paper web 58, which has been, for example, 4/4 printed, has left the top of the multiple printing system 6, traveling in the vertical direction, it is turned, for example in a contact free manner by a paper guide roller 61 and is fed into an inlet end of a hot air dryer 62. The hot air dryer 62 is located on a second horizontal plane 63 by the supports 71 and 72. As may be seen in FIG. 1, this second horizontal plane 63 is located above the first horizontal plane 59. The hot air dryer 62 extends over the roll changer 56 and the draw-in unit 57 and also extends partially over the multiple printing systems 6. At the least, the hot air dryer 62 extends over the roll changer 56. As viewed in the direction of travel of the printed paper web 58, the hot air dryer 62 is followed by a generally known cooling cylinder unit 64 which is also located on the second, upper horizontal plane 63. A turning bar superstructure 66 is situated beneath the cooling cylinder unit 64 and is used to direct the printed paper web 58 to an inlet funnel or former unit 67 and then to a folding device 68 with a suitable folded product delivery assembly. As may be seen in FIG. 1, the folding device 68 is located on the first, lower horizontal plane 59 and on the opposite side of the roll changer 56 from the draw-in unit 57.

Figure 6:
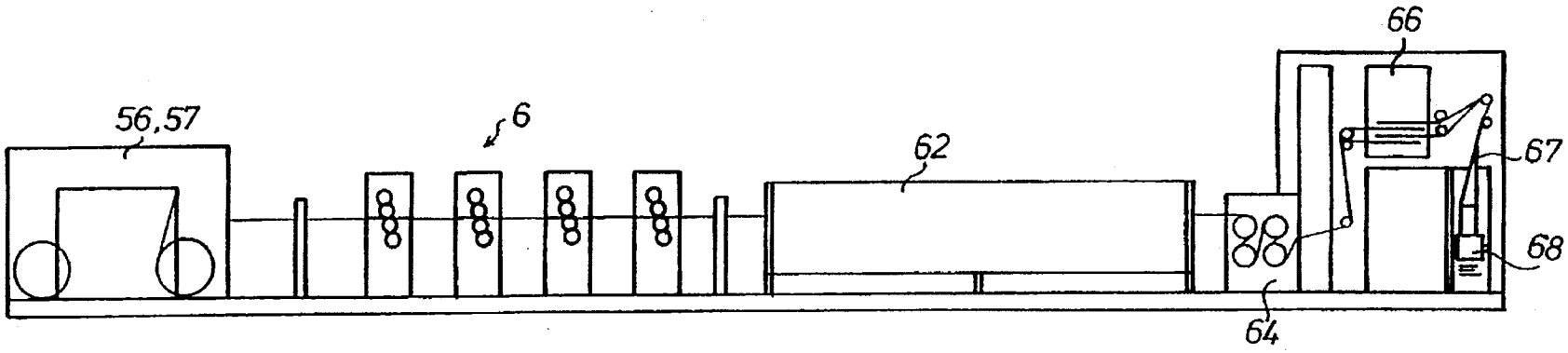
FIG. 6 is a schematic side elevation view of a prior art multi-color, web-fed rotary printing press for job printing.

As may be seen by comparing the prior art structure shown in FIG. 6 with the present invention, depicted in FIG. 7, the present invention provides a substantially shorter structural length printing press while maintaining the same structural height. The multi-color, web-fed rotary printing press for job printing in accordance with the present invention makes possible the accomplishment of 4/4 printing. It is also possible to operate the subject printing press in the "imprinter" mode. The rubber blankets and the printing cylinders are rendered easily accessible by the use of at least one horizontally shiftable frame component so that necessary maintenance work, as well as manual changing of rubber blanket packings or of printing plates can be made. It is also possible to accomplish the automatic changing of printing plates by use of known printing plate changing devices. It is also possible to change a printing forme by means of an exposure and blanketing unit without having to take the printing forme out of the press. It is also possible to employ printing cylinders or rubber blanket cylinders whose diameter has changed. In this case, as shown in FIG. 3, the bearing units for the journals of the cylinders must be embodied as being exchangeable. When using a generally known device, as is shown in German Patent Publication DE 3500319 A1, it is also possible to clamp the cylinders on one side so that the cylinders still present in the printing press can be provided with endless packings, such as rubber blanket or print packing. In accordance with the present invention, it will be understood that in a bridge printing arrangement, the rubber blanket cylinders of a printing station are located next to each other whereas in a non-bridge arrangement they are located above and below each other.

While a preferred embodiment of a short, multi-color, web-fed rotary printing press in accordance with the present invention has been set forth fully and completely hereinabove, it will be apparent to one of skill in the art that a number of changes in, for example, the lengths of the cylinders, the type of paper web being printed, the types of printing plates used and the like could be made without departing from the true spirit and scope of the present invention which is accordingly to be limited only by the following claims.

What is claimed is:

1. A short, multi-color, web-fed rotary printing press for job printing of a paper web comprising:

a multiple printing system having a plurality of bridge printing units located on a first horizontal plane and arranged above each other with each such bridge printing unit having a left printing unit including a left printing cylinder and a left blanket cylinder and a right printing unit including a right printing cylinder and a right blanket cylinder, each said printing cylinder resting on an upper half of an associated blanket cylinder, each said printing cylinder having a printing cylinder circumference, each said blanket cylinder having a blanket cylinder circumference which is a whole number multiple of said printing cylinder circumference;

a left frame section supporting said left printing units and a right frame section supporting said right printing units, said left frame section and said right frame section being shiftable toward and away from each other to move said left blanket cylinder and said right blanket cylinder of each of said bridge printing units into and out of contact with each other;

a roll changer usable to feed a paper web to said multiple printing system; and a printed paper web dryer and a folding device to dry and fold a printed web printed in said multiple printing system.

2. A short, multi-color, web-fed rotary printing press for job printing of a paper web comprising:

a multiple printing system having a plurality of bridge printing units located on a first plane and arranged above each other with each such bridge printing unit having a left printing unit including a left inking unit, a left printing cylinder and a left blanket cylinder and a right printing unit including a right inking unit, a right printing cylinder and a right blanket cylinder, each said printing cylinder resting on an upper half of an associated blanket cylinder, each said printing cylinder having a printing cylinder circumference, each said blanket cylinder having a blanket cylinder circumference which is a whole number multiple of said printing cylinder circumference;

a left movable frame section supporting said left inking units and said left printing cylinders;

a right movable frame section supporting said right inking units and said right printing cylinders;

a center fixed frame section supporting said left and right blanket cylinders, said left and right frame sections being movable to bring said left and right printing cylinders in and out of contact with said left and right blanket cylinders;

a roll changer usable to feed a paper web to said multiple printing system; and a printed web dryer and a folding device to dry and fold a printed web printed in said multiple printing system.

3. The printing press of claim 1 wherein one of said left and right frame sections is fixed on a support.

4. The printing press of claim 1 further including means to lock said left and right frame sections in place in an operational position.

5. The printing press of claim 2 further including means to lock said left and right frame sections in place with respect to said center frame section in an operational position.

6. The printing press of claim 1 further including a cooling cylinder unit, said dryer and said cooling cylinder being disposed on a second horizontal plane.

7. The printing press of claim 2 further including a cooling cylinder unit, said dryer and said cooling cylinder being disposed on a second horizontal plane.

8. The printing press of claim 1 wherein said dryer is disposed above said roll changer.

9. The printing press of claim 2 wherein said dryer is disposed above said roll changer.

10. The printing press of claim 1 further including a paper web draw-in unit, said dryer being disposed above said roll changer and said draw-in unit.

11. The printing press of claim 2 further including a paper web draw-in unit, said dryer being disposed above said roll changer and said draw-in unit.

12. The printing press of claim 10 wherein said dryer is disposed above said roll changer and said draw-in unit and at least partially above said multiple printing system.

13. The printing press of claim 11 wherein said dryer is disposed above said roll changer and said draw-in unit and at least partially above said multiple printing system.

14. A short multi-color, web-fed rotary printing unit usable in job printing to print a paper web comprising:

a multiple printing system having a plurality of bridge printing units positioned vertically above one another, each said bridge printing unit having first and second blanket cylinders and first and second printing cylinders, each said printing cylinder being engageable with an upper half of its associated blanket cylinder, each said printing cylinder having a printing cylinder circumference, each of said blanket cylinders having a blanket cylinder circumference at least twice as large as its associated printing cylinder circumference and being a whole number multiple thereof;

shiftable support means supporting at least a portion of each said bridge printing unit, said shiftable support means being usable to shift said bridge printing units between operational and non-operational positions;

a roll changer usable to supply a paper web to said multiple printing system; and a printed paper web drier positioned above said roll changer to receive a printed paper web from said multiple printing system.

* * * * *